US008831797B2

(12) United States Patent
Shirao et al.

(10) Patent No.: US 8,831,797 B2
(45) Date of Patent: Sep. 9, 2014

(54) WHEEL LOADER

(71) Applicant: Komatsu Ltd., Tokyo (JP)

(72) Inventors: Atsushi Shirao, Komatsu (JP); Masanori Ikari, Komatsu (JP)

(73) Assignee: Komatsu Ltd., Tokyo (JP)

( * ) Notice: Subject to any disclaimer, the term of this patent is extended or adjusted under 35 U.S.C. 154(b) by 3 days.

(21) Appl. No.: 13/824,447

(22) PCT Filed: Sep. 19, 2012

(86) PCT No.: PCT/JP2012/073869

§ 371 (c)(1), (2), (4) Date: Mar. 18, 2013

(87) PCT Pub. No.: WO2014/041701

PCT Pub. Date: Mar. 20, 2014

(65) Prior Publication Data

US 2014/0129093 A1 May 8, 2014

(51) Int. Cl.
*E02F 3/43* (2006.01)

(52) U.S. Cl.
CPC ..... *E02F 3/433* (2013.01); *E02F 3/432* (2013.01)
USPC ..... 701/5

(58) Field of Classification Search
USPC ..... 701/5
See application file for complete search history.

(56) References Cited

U.S. PATENT DOCUMENTS 4,825,568 A * 5/1989 Kawamura et al. ..... 37/442
6,879,899 B2 * 4/2005 Budde ..... 701/50
7,555,855 B2 * 7/2009 Alshaer et al. ..... 37/382
7,568,878 B2 * 8/2009 Frey ..... 414/686
7,779,947 B2 * 8/2010 Stratton ..... 180/197
7,853,384 B2 * 12/2010 Johnson et al. ..... 701/50
7,993,091 B2 * 8/2011 Osanai et al. ..... 414/697
8,036,797 B2 * 10/2011 Johnson et al. ..... 701/50

(Continued)

FOREIGN PATENT DOCUMENTS

JP 2006-207329 A 8/2006

(Continued)

OTHER PUBLICATIONS

The extended European search report for the corresponding European application No. 12840834.1, issued on Dec. 4, 2013.
International Search Report for PCT/JP2012/073869.

*Primary Examiner* — Thomas Tarcza
*Assistant Examiner* — Alex C Dunn
(74) *Attorney, Agent, or Firm* — Global IP Counselors, LLP

(57) ABSTRACT

A wheel loader includes a vehicle body, a work implement, a link mechanism and a control section. The work implement has a boom a work tool. The link mechanism is configured and arranged to change a relative angle of the work tool with respect to the boom when the boom is rotated upward, such that an amount of variation of an angle of the work tool with respect to a horizontal direction is less than an amount of variation of an angle of the work tool with respect to the horizontal direction when the boom is rotated upward while the work tool is at a fixed relative angle with respect to the boom. The control section is configured to execute an auto tilt control that causes the work tool to rotate upward when the boom is rotated upward within an angular range below the horizontal direction during excavation.

7 Claims, 12 Drawing Sheets

(56) References Cited

U.S. PATENT DOCUMENTS

| | | | | |
|---|---|---|---|---|
| 8,156,048 | B2 * | 4/2012 | Mintah et al. | 705/50 |
| 8,160,783 | B2 * | 4/2012 | Shull | 701/50 |
| 2004/0117092 | A1 * | 6/2004 | Budde | 701/50 |
| 2007/0260380 | A1 * | 11/2007 | Mintah et al. | 701/50 |
| 2009/0326768 | A1 * | 12/2009 | Shull | 701/50 |

FOREIGN PATENT DOCUMENTS

| | | | | |
|---|---|---|---|---|
| JP | 2007-224511 | A | | 9/2007 |
| JP | 2007224511 | A | * | 9/2007 |
| JP | 2009-197425 | A | | 9/2009 |
| JP | 2011-184886 | A | | 9/2011 |
| JP | 2010-265639 | A | | 11/2011 |

* cited by examiner

WHEEL LOADER

CROSS-REFERENCE TO RELATED APPLICATIONS

This application claims priority to Japanese Patent Application No. 2012-200521 filed on September 12, the disclosure of which is hereby incorporated herein by reference in its entirety.

TECHNICAL FIELD

The present invention relates to a wheel loader.

BACKGROUND ART

A wheel loader is provided with a vehicle body, and a work implement attached to the vehicle body. The work implement has a boom and a work tool. The boom is rotatably attached to the vehicle body. The work tool is, for example, a bucket, a fork, or the like, attached to the distal end of the boom.

As disclosed in Japanese Laid-Open Patent Application 2010-265639, a work implement is provided with a link mechanism, such as a parallel link mechanism, a Z bar link mechanism, or the like. The link mechanism is a mechanism that couples the boom and the work tool, and operates the work tool in interlocking fashion with operation of the boom. In a wheel loader outfitted with a Z bar link mechanism, as the boom rotates upward, the angle of the work tool varies with respect to the horizontal direction. However, when, for example, the bucket is raised high with the bucket in a loaded state, it is preferable for the angle of the bucket to be maintained on the horizontal.

Accordingly, a parallel link mechanism is designed to change the relative angle of the bucket with respect to the boom as the boom is rotated upwards, so as to maintain the angle of the bucket on the horizontal. In addition to the parallel link mechanism mentioned above, link mechanisms having a function of keeping to a low level variation of the angle of the bucket with respect to the horizontal direction as the boom is rotated upwards (hereinafter termed an attitude-retention function) are known as well. In the following description, the term "parallel link mechanism" is not limited to parallel link mechanisms in the narrow sense, and includes other link mechanisms having an attitude-retention function.

SUMMARY

During excavation work by a wheel loader, the bucket is pushed into an object such as gravel. At this time, in order to prevent the tires from slipping, in many cases the operator will increase the ground contact pressure of the tires by performing upward maneuvering of the boom, while at the same time thrusting the blade edge of the bucket into the object.

At this time, in a wheel loader that has been outfitted with a Z bar link mechanism, due to a structure whereby the bucket rotates upward to an appropriate degree simultaneously with upward rotation of the boom, the object will readily enter into the bucket through maneuvering of the boom only, without maneuvering the bucket. Furthermore, even in a case in which the operator continues upward maneuvering of the boom, the reaction force to which the work implement is subjected is moderated through upward rotation of the bucket to an appropriate degree. Stalling and/or a rise in hydraulic pressure of the boom cylinder is thereby kept to a minimum, and the boom is easily elevated, thereby providing good maneuverability when scooping.

In a wheel loader that has been outfitted with a parallel link mechanism, on the other hand, the angle of the bucket is substantially fixed regardless of upward rotation of the boom. Therefore, with upward maneuvering of the boom only, the work implement is subjected to strong reaction force during excavation, making the boom hard to lift. Therefore, when initiating excavation, unless the bucket is maneuvered to rotate upward simultaneously with upward maneuvering of the boom, satisfactory excavation workability is not obtained.

As object of the present invention is to offer a wheel loader whereby satisfactory excavation workability can be obtained, though simple maneuvering.

A wheel loader according to a first aspect of the present invention is provided with a vehicle body, a work implement, a link mechanism, and a control section. The work implement has a boom and a work tool. The boom is attached rotatably in the up and down directions to the vehicle body. The work tool is attached rotatably in the up and down directions to the distal end of the boom. The link mechanism changes the relative angle of the work tool with respect to the boom, when the boom is rotated upward. The amount of variation of the angle of the work tool with respect to the horizontal direction is thereby less than the amount of variation of the angle of the work tool with respect to the horizontal direction when the boom is rotated upward while the work tool is at a fixed relative angle with respect to the boom. The control section executes auto tilt control. During the auto tilt control, the control section rotates the work tool upward when the boom is rotated within an angular range below the horizontal direction during excavation.

A wheel loader according to a second aspect of the present invention is the wheel loader of the first aspect, wherein the control section terminates the auto tilt control when a predetermined time interval has elapsed from a start time of the auto tilt control.

A wheel loader according to a third aspect of the present invention is the wheel loader of the first or second aspect, wherein the control section terminates the auto tilt control when the angle of the boom with respect to the horizontal direction has reached a predetermined angle below the horizontal direction.

A wheel loader according to a fourth aspect of the present invention is the wheel loader of any of the first to third aspects, further provided with a work implement hydraulic pump for discharging hydraulic fluid. The work implement further has a boom cylinder for driving the boom. The control section determines whether excavation is currently taking place, on the basis of the magnitude of the hydraulic pressure supplied to the boom cylinder to rotate the boom upward.

A wheel loader according to a fifth aspect of the present invention is the wheel loader of any of the first to fourth aspects, further provided with a traction parameter detector. The traction parameter detector detects the value of a traction parameter. The traction parameter is a parameter that shows the magnitude of traction of the wheel loader towards the direction of forward advance. The control section determines whether to execute the auto tilt control, on the basis of whether the traction parameter is equal to or greater than a predetermined value.

A wheel loader according to a sixth aspect of the present invention is the wheel loader of any of the first to fifth aspects, further provided with a selector for selecting whether to enable or disable the auto tilt control.

A wheel loader according to a seventh aspect of the present invention is the wheel loader of any of the first to sixth aspects, further provided with a work implement maneuvering section and a work implement locking maneuver section.

An operator maneuvers the work implement via the work implement maneuvering section. The work implement locking maneuver section locks the work implement regardless of maneuvering by the work implement maneuvering section. When the work implement is locked by the work implement locking maneuver section, the control section does not execute the auto tilt control.

A wheel loader control method according to an eighth aspect of the present invention is provided with the following steps. In a first step, the boom is rotated upwards. In a second step, the relative angle of the work tool with respect to the boom is changed by the link mechanism, when the boom is rotated upward. The amount of variation of the angle of the work tool mounted to the distal end of the boom, with respect to the horizontal direction, is thereby less than the amount of variation of the angle of the work tool with respect to the horizontal direction when the boom is rotated upward while the work tool is at a fixed relative angle with respect to the boom. In a third step, auto tilt control is executed. During the auto tilt control, the work tool is rotated upward when the boom is rotated upward within an angular range below the horizontal direction during excavation.

In the wheel loader according to the first aspect of the present invention, the work tool is rotated upward automatically when the boom is rotated upward within an angular range below the horizontal direction during excavation. Satisfactory excavation workability can be obtained thereby, even when the operator does not perform maneuvering of the work tool simultaneously with maneuvering of the work boom.

In the wheel loader according to the second aspect of the present invention, automatic control of the work tool is limited to the time at which excavation is initiated, when the reaction force to which work implement is subjected is strong. Unnecessary automatic control of the work tool is thereby kept to a minimum.

In the wheel loader according to the third aspect of the present invention, the auto tilt control is canceled when the work tool has been raised to a major extent. The maneuverability afforded by the attitude-retention function of the link mechanism in a state in which the work tool has been raised to a major extent can be improved thereby.

In the wheel loader according to the fourth aspect of the present invention, the control section can accurately determine whether excavation is currently taking place, on the basis of the magnitude of the hydraulic pressure supplied to the boom cylinder.

In the wheel loader according to the fifth aspect of the present invention, the auto tilt control is executed when traction towards the direction of forward advance is strong. The auto tilt control can thereby be performed under circumstances in which the reaction force to which work implement is subjected is strong.

In the wheel loader according to the sixth aspect of the present invention, at times when the auto tilt control is unnecessary, the operator can disable the auto tilt control through the selector. Unnecessary control of the work tool is kept to a minimum thereby, improving maneuverability.

In the wheel loader according to the seventh aspect of the present invention, the auto tilt control is not executed when the work implement is locked by the work implement locking maneuver section. Unintended execution of the auto tilt control can thereby be avoided.

In the wheel loader control method according to the eighth aspect of the present invention, the work tool is rotated upward automatically when the boom is rotated upward within an angular range below the horizontal direction during excavation. Satisfactory excavation workability can be obtained thereby, even when the operator does not perform maneuvering of the work tool simultaneously with maneuvering of the work boom.

DESCRIPTION OF THE EMBODIMENTS

Figure 1:
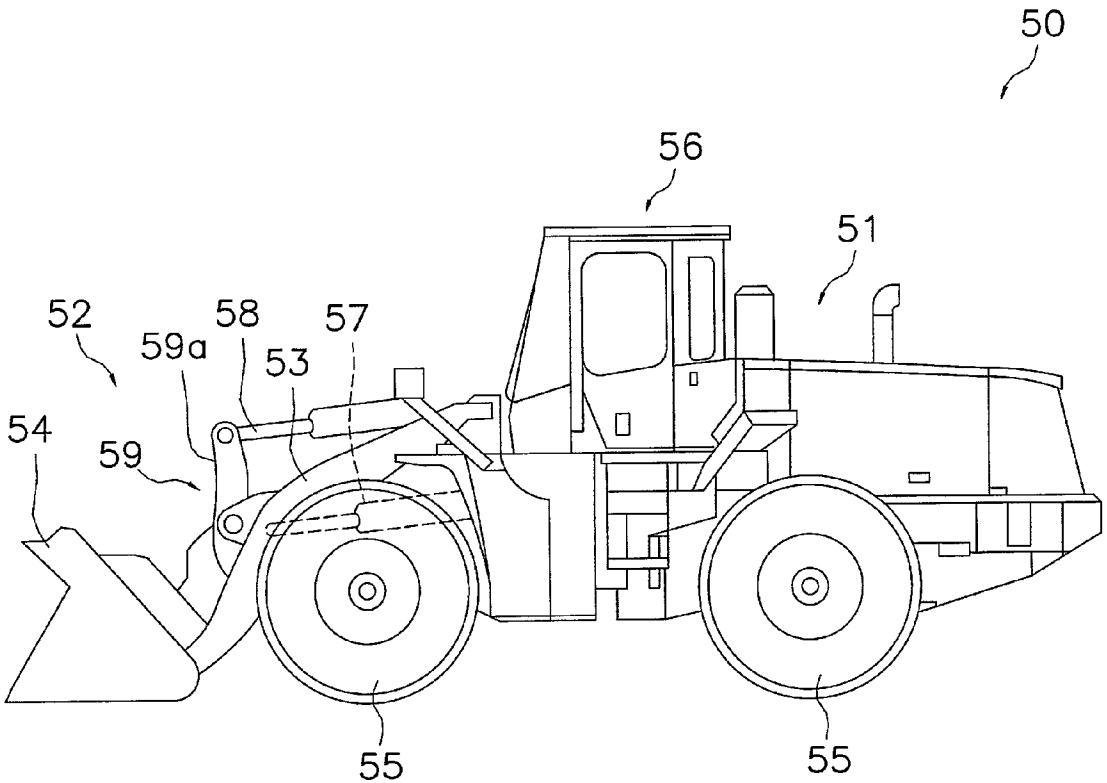
FIG. 1 is a side view of a wheel loader according to an embodiment of the present invention.

The following description of a wheel loader 50 according to an embodiment of the present invention employs the accompanying drawings. FIG. 1 is a perspective view of the wheel loader 50. The wheel loader 50 has a vehicle body 51, a work implement 52, a plurality of tires 55, a cab 56, and a link mechanism 59. The cab 56 is installed on the vehicle body 51. The work implement 52 is attached to the front section of the vehicle body 51. The work implement 52 has a boom 53, a bucket 54, a boom cylinder 57, and a bucket cylinder 58.

The boom 53 is a member for raising the bucket 54. The boom 53 is attached rotatably in the up and down directions to the vehicle body 51. The boom 53 is rotated up and down by the boom cylinder 57. The bucket 54 is attached rotatably in the up and down directions to the distal end of the boom 53. The bucket 54 is rotated up and down by the bucket cylinder 58. In the following description, "tilting" refers to an operation of rotating the bucket 54 upward. "Dumping" refers to an operation of rotating the bucket 54 downward. Other work tools, such as a fork, can be attached to the boom 53 in place of the bucket 54.

Figure 2:
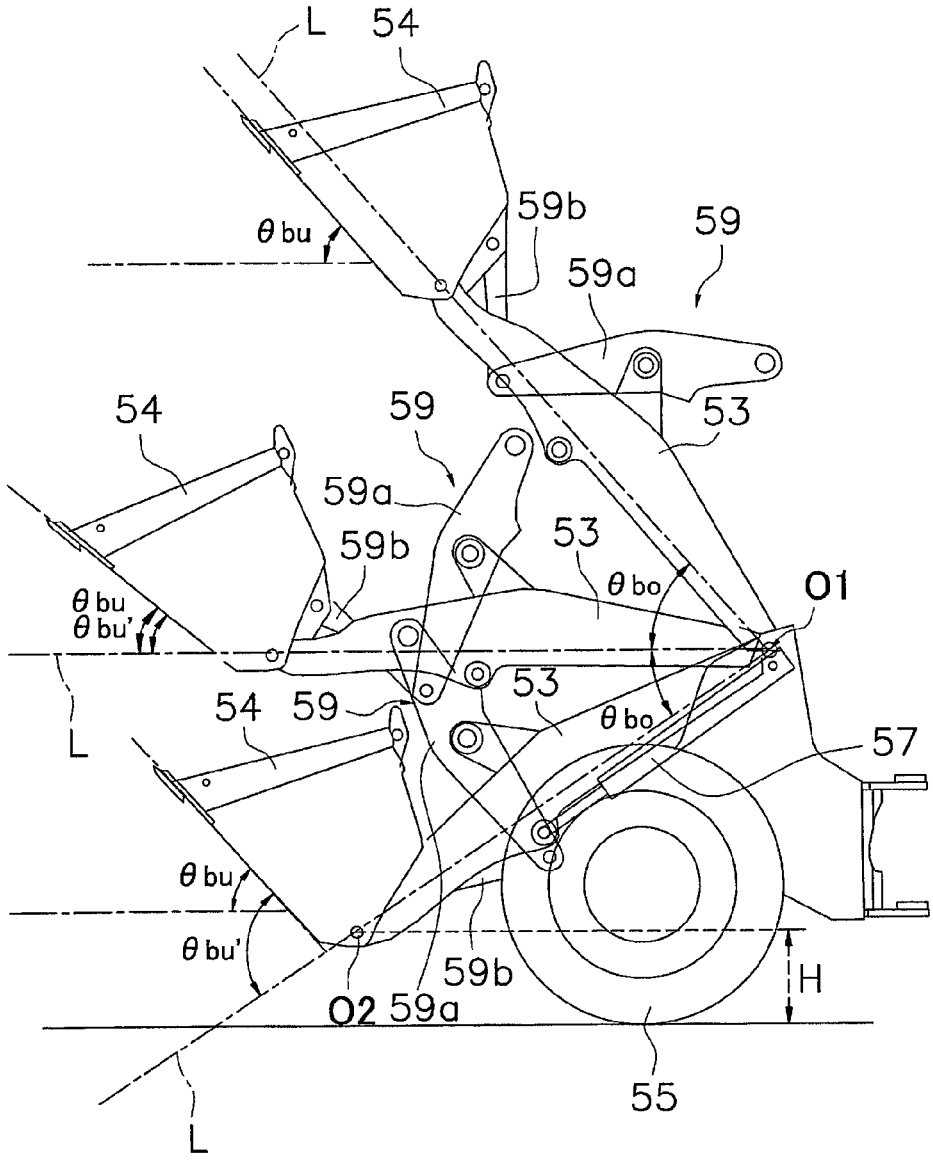
FIG. 2 is a side view showing the front part of the wheel loader.

As shown in FIG. 2, the link mechanism 59 has a bell crank 59*a* and a coupling link 59*b*. The link mechanism 59 operates the bucket 54 in interlocking fashion with operation of the boom 53.

The bell crank 59*a* is coupled to the boom 53 in proximity to the center thereof in the lengthwise direction. The bell crank 59*a* is rotatably coupled to the boom 53. One end of the bell crank 59*a* is coupled to the bucket cylinder 58 (see FIG. 1). The other end of the bell crank 59*a* is coupled to the coupling link 59*b*. One end of the coupling link 59*b* is rotatably coupled to the back surface of the bucket 54. The other end of the coupling link 59*b* is rotatably coupled to the bell crank 59*a*.

When the boom 53 is rotated up or down, the link mechanism 59 changes the bucket relative angle θbu' in such a way that the amount of variation of the bucket angle θbu is less than the amount of variation of the bucket angle θbu when the boom 53 is rotated upward at a fixed bucket relative angle θbu'. The bucket angle θbu is the angle of the bottom surface of the bucket 54 with respect to the horizontal direction. The bucket relative angle θbu' is the angle of the bottom surface of the bucket 54 with respect to a reference line L of the boom 53. The reference line L of the boom 53 is a line that connects the center of rotation O1 of the boom 53 with respect to the vehicle body 51, and the center of rotation O2 of the bucket 54 with respect to the boom 53.

In specific terms, the link mechanism 59 changes the bucket relative angle θbu' in response to variation of the boom angle θbo, in such a way that the bucket angle θbu is fixed. Specifically, the link mechanism 59 maintains a fixed bucket angle θbu when the boom 53 rotates up or down. The bucket 54 undergoes parallel movement thereby. The boom angle θbo is the angle of the reference line L of the boom 53 with respect to the horizontal direction. In side view, the boom angle θbo is 0 degrees in the horizontal direction. Angles below the horizontal direction are negative values, while angles above the horizontal direction are positive values.

Figure 3:
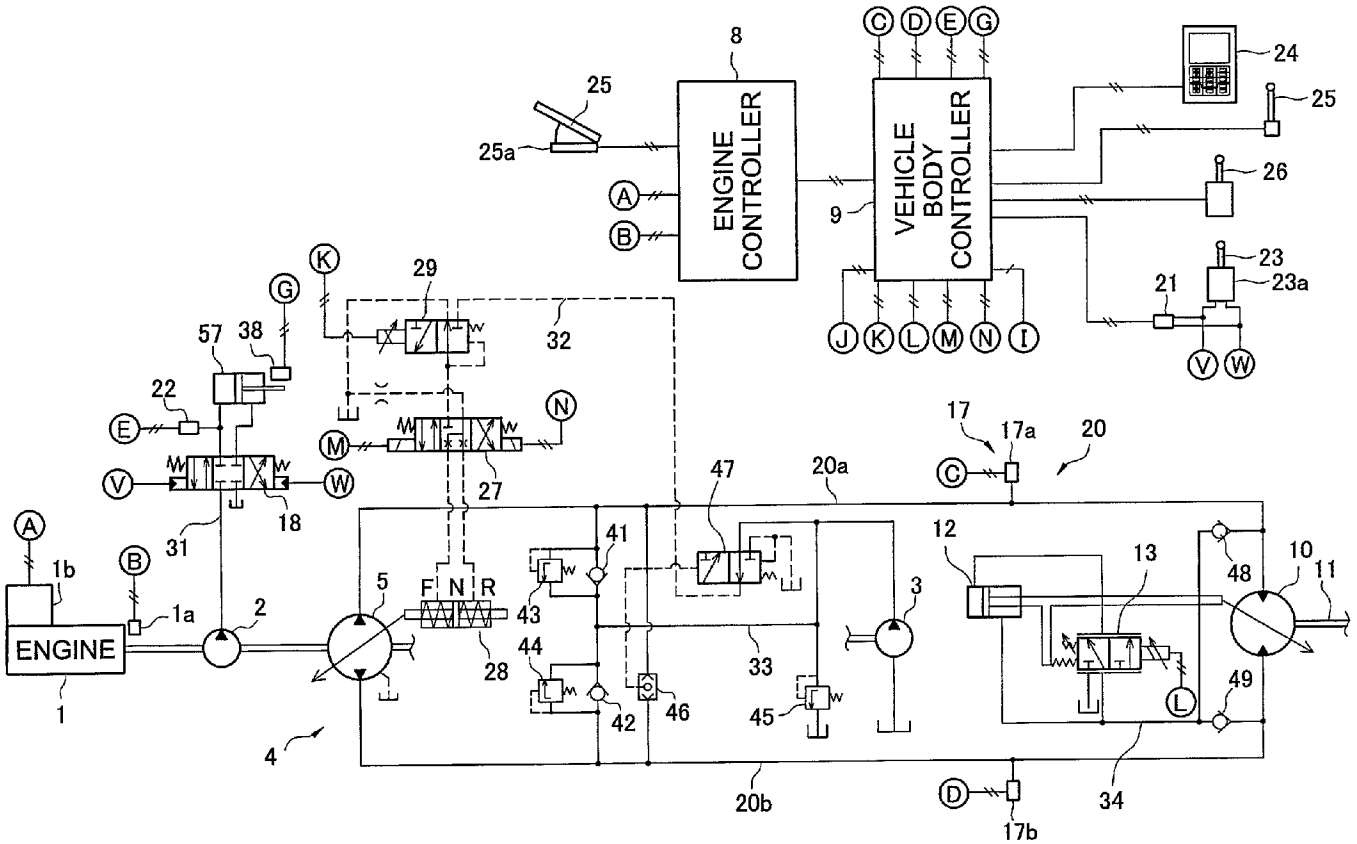
FIG. 3 is a block diagram showing the constitution of a hydraulic circuit outfitted to the wheel loader.
Figure 4:
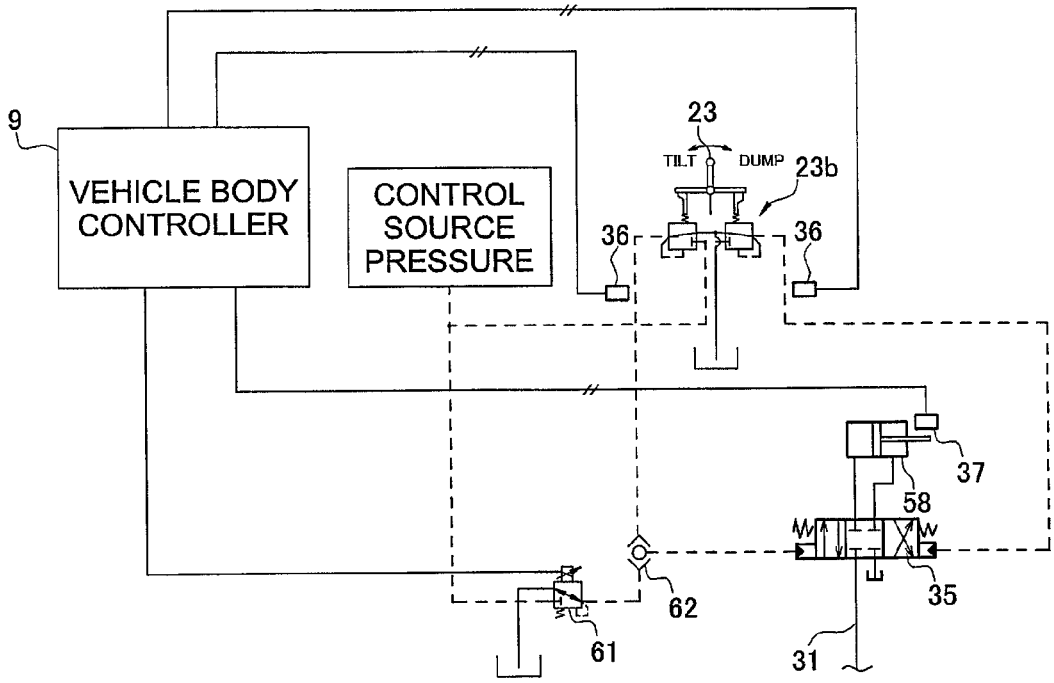
FIG. 4 is a block diagram showing the constitution of a hydraulic circuit outfitted to the wheel loader.

FIGS. 3 and 4 are block diagrams showing the constitution of a hydraulic circuit outfitted to the wheel loader 50. The wheel loader 50 primarily has an engine 1, a work implement hydraulic pump 2, a charge pump 3, a traveling mechanism 4, an engine controller 8, and a vehicle body controller 9 (one example of a control section).

The engine 1 is an engine of diesel type. Output torque generated by the engine 1 is transmitted to the work implement hydraulic pump 2, the charge pump 3, the traveling mechanism 4, and so on. The actual rotation speed of the engine 1 is detected by an engine rotation speed sensor 1*a*. A fuel injection device 1*b* is connected to the engine 1. The engine controller 8 controls the fuel injection device 1*b* in response to a set target engine rotation speed, thereby controlling the output torque and rotation speed of the engine 1.

The traveling mechanism 4 causes the wheel loader 50 to travel due to driving force from the engine 1. The traveling mechanism 4 has a travel hydraulic pump 5, a hydraulic motor 10, and a drive hydraulic circuit 20.

The travel hydraulic pump 5, driven by the engine 1, thereby discharges hydraulic fluid. The travel hydraulic pump 5 is a hydraulic pump of variable displacement type. The hydraulic fluid discharged by the travel hydraulic pump 5 passes through the drive hydraulic circuit 20 and is delivered to the hydraulic motor 10. The travel hydraulic pump 5 is capable of changing the direction of discharge of the hydraulic fluid. In specific terms, the drive hydraulic circuit 20 has a first drive circuit 20*a* and a second drive circuit 20*b*.

The hydraulic fluid is supplied from the travel hydraulic pump 5 to the hydraulic motor 10 via the first drive circuit 20*a*, thereby driving the hydraulic motor 10 in one direction (for example, the direction of forward advance). In this case, the hydraulic fluid returns from the hydraulic motor 10 to the travel hydraulic pump 5 via the second drive circuit 20*b*. By supplying the hydraulic fluid from the travel hydraulic pump 5 to the hydraulic motor 10 via the second drive circuit 20*b*, the hydraulic motor 10 is driven in another direction (for example, the direction of rearward advance). In this case, the hydraulic fluid returns from the hydraulic motor 10 to the travel hydraulic pump 5 via the first drive circuit 20*a*.

The hydraulic motor 10 then drives rotation of the aforementioned tires 55 via a drive shaft 11, causing the wheel loader 50 to travel. Specifically, a so-called one-pump, one-motor HST system has been adopted in the wheel loader 50.

The drive hydraulic circuit 20 is furnished with a drive circuit pressure detector 17 (one example of a traction parameter detector). The drive circuit pressure detector 17 detects the pressure of the hydraulic fluid supplied to the hydraulic motor 10 via the first drive circuit 20*a* or the second drive circuit 20*b* (hereinafter termed the "drive circuit pressure"). In specific terms, the drive circuit pressure detector 17 has a first drive circuit pressure sensor 17*a* and a second drive circuit pressure sensor 17*b*. The first drive circuit pressure sensor 17*a* detects the hydraulic pressure of the first drive circuit 20*a*. The second drive circuit pressure sensor 17*b* detects the hydraulic pressure of the second drive circuit 20*b*. The first drive circuit pressure sensor 17*a* and the second drive circuit pressure sensor 17*b* send detection signals to the vehicle body controller 9. A forward/rearward advance changeover valve 27 and a pump displacement control cylinder 28 for controlling the direction of discharge of the travel hydraulic pump 5 are connected to the travel hydraulic pump 5.

The forward/rearward advance changeover valve 27 is an electromagnetic control valve for switching the direction of supply of hydraulic fluid to the pump displacement control cylinder 28, on the basis of a control signal from the vehicle body controller 9. The pump displacement control cylinder 28, driven by hydraulic fluid supplied via a pump pilot circuit 32, changes the tilting angle of the travel hydraulic pump 5. The pump displacement control cylinder 28 switches the direction of discharge of the hydraulic fluid from the travel hydraulic pump 5, in response to the direction of supply of the hydraulic fluid supplied to the pump displacement control cylinder 28.

A pressure control valve 29 is disposed in the pump pilot circuit 32. The pressure control valve 29 is an electromagnetic control valve controlled on the basis of a control signal from the vehicle body controller 9. The pressure control valve 29 controls the hydraulic pressure of the pump pilot circuit 32, thereby adjusting the tilting angle of the travel hydraulic pump 5.

The pump pilot circuit 32 is connected, via a cutoff valve 47, to a charge circuit 33 and to a hydraulic fluid tank. A pilot port of the cutoff valve 47 is connected to the first drive circuit 20*a* and to the second drive circuit 20*b*, via a shuttle valve 46. The shuttle valve 46 introduces either the hydraulic pressure of the first drive circuit 20*a* or the hydraulic pressure of the second drive circuit 20*b*, whichever is greater, to the pilot port of the cutoff valve 47. When the drive circuit pressure reaches a predetermined cutoff pressure or above, the cutoff valve 47 places the pump pilot circuit 32 in communication with the hydraulic fluid tank. The hydraulic pressure of the pump pilot circuit 32 is lowered by doing so, thereby reducing the displacement of the travel hydraulic pump 5, and keeping to a minimum the rise in drive circuit pressure.

The charge pump 3 is a pump that, driven by the engine 1, supplies hydraulic fluid to the drive hydraulic circuit 20. The charge pump 3 is connected to the charge circuit 33. The charge pump 3 supplies the hydraulic fluid to the pump pilot circuit 32 via the charge circuit 33. The charge circuit 33 is connected to the first drive circuit 20*a* via a first check valve 41. The charge circuit 33 is connected to the second drive circuit 20*b* via a second check valve 42.

The charge circuit 33 is connected to the first drive circuit 20*a* via a first relief valve 43. The first relief valve 43 opens when the hydraulic pressure of the first drive circuit 20*a* is greater than a predetermined pressure. The charge circuit 33 is connected to the second drive circuit 20*b* via a second relief valve 44. The second relief valve 44 opens when the hydraulic pressure of the second drive circuit 20*b* is greater than a predetermined pressure.

The charge circuit 33 is connected to the hydraulic fluid tank via a low-pressure relief valve 45. The low-pressure relief valve 45 opens when the hydraulic pressure of the charge circuit 33 is greater than a predetermined relief pressure. When the drive circuit pressure is lower than the hydraulic pressure of the charge circuit 33, hydraulic fluid is supplied from the charge circuit 33 to the drive hydraulic circuit 20, via the first check valve 41 or the second check valve 42.

The work implement hydraulic pump 2 is driven by the engine 1. The work implement hydraulic pump 2 is a hydraulic pump for driving the work implement 52. The hydraulic fluid discharged from the work implement hydraulic pump 2 is supplied to the boom cylinder 57 and to the bucket cylinder 58 via a work implement hydraulic circuit 31. The work implement 52 is driven thereby.

As shown in FIG. 3, the work implement hydraulic circuit 31 is furnished with a boom control valve 18. The boom control valve 18 is driven in response to the amount of maneuvering of a work implement maneuvering section 23. The boom control valve 18 controls the flow rate of the hydraulic fluid supplied to the boom cylinder 57, in response to the pilot pressure applied to the pilot port of the boom control valve 18 (hereinafter termed "boom PPC pressure"). The boom PPC pressure is controlled by a boom PPC valve 23*a* of the work implement maneuvering section 23. The boom PPC valve 23*a* applies pilot pressure commensurate with the amount of maneuvering of the work implement maneuvering section 23 to the pilot port of the boom control valve 18. The boom cylinder 57 is thereby controlled in response to the amount of maneuvering of the work implement maneuvering section 23.

The boom PPC pressure is detected by a boom PPC pressure sensor 21. The pressure of the hydraulic fluid supplied to the boom cylinder 57 is detected by a boom pressure sensor 22. The boom PPC pressure sensor 21 and the boom pressure sensor 22 send detection signals to the vehicle body controller 9.

The boom 53 is furnished with a boom angle sensor 38. The boom angle sensor 38 detects the boom angle θbo. The boom angle sensor 38 sends a detection signal to the vehicle body controller 9.

As shown in FIG. 4, the work implement hydraulic circuit 31 is furnished with a bucket control valve 35. The bucket control valve 35 is driven in response to the amount of maneuvering of the work implement maneuvering section 23. The bucket control valve 35 controls the flow rate of the hydraulic fluid supplied to the bucket cylinder 58, in response to pilot pressure applied to the pilot port of the bucket control valve 35 (hereinafter termed "bucket PPC pressure"). The bucket PPC pressure is controlled by a bucket PPC valve 23*b* of the work implement maneuvering section 23. The bucket PPC valve 23*b* applies pilot pressure commensurate with the amount of maneuvering of the work implement maneuvering section 23, to the pilot port of the bucket control valve 35. The bucket cylinder 58 is thereby controlled in response to the amount of maneuvering of the work implement maneuvering section 23.

The bucket PPC pressure is detected by a bucket PPC pressure sensor 36. The bucket PPC pressure sensor 36 sends a detection signal to the vehicle body controller 9. The bucket cylinder 58 is furnished with a proximity switch 37 for detecting when the bucket angle θbu has exceeded a predetermined threshold value. The predetermined threshold value corresponds to the bucket angle θbu observed in a state of maximum tilt operation of the bucket 54. Consequently, the proximity switch 37 detects whether the bucket 54 is in a state of maximum tilt operation.

The work implement hydraulic circuit 31 is furnished with a bucket tilt control valve 61 and a high pressure selection valve 62. The bucket tilt control valve 61 is an electromagnetic control valve for controlling the pilot pressure applied to the control valve 35, on the basis of a control signal from the vehicle body controller 9. The high pressure selection valve 62 selects the higher of the pilot pressure supplied by the bucket tilt control valve 61 and the pilot pressure supplied by the bucket PPC valve 23*b*, and supplies the higher pilot pressure to the pilot port of the bucket control valve 35. The bucket cylinder 58 can thereby be controlled by a control signal from the vehicle body controller 9, without maneuvering the work implement maneuvering section 23.

The hydraulic motor 10 shown in FIG. 3 is a hydraulic motor 10 of variable displacement type. The hydraulic motor 10 is driven by hydraulic fluid discharged from the travel hydraulic pump 5. The hydraulic motor 10 is a motor for travel purposes, and generates driving force for rotating the tires 55. The hydraulic motor 10 changes driving direction between the forward advance direction and the rearward advance direction, in response to the direction of discharge of the hydraulic fluid from the travel hydraulic pump 5.

The hydraulic motor 10 is furnished with a motor cylinder 12 and a motor displacement control section 13. The motor cylinder 12 changes the tilting angle of the hydraulic motor 10. The motor displacement control section 13 is an electromagnetic control valve controlled on the basis of a control signal from the vehicle body controller 9. The motor displacement control section 13 controls the motor cylinder 12 on the basis of a control signal from the vehicle body controller 9.

The motor cylinder 12 and the motor displacement control section 13 are connected to a motor pilot circuit 34. The motor pilot circuit 34 is connected to the first drive circuit 20*a* via a check valve 48. The motor pilot circuit 34 is connected to the second drive circuit 20*b* via a check valve 49. Through the check valves 48, 49, the hydraulic pressure of the first drive circuit 20*a* or of the second drive circuit 20*b*, whichever is higher, specifically, hydraulic fluid at drive circuit pressure, is supplied to the motor pilot circuit 34.

On the basis of a control signal from the vehicle body controller 9, the motor displacement control section 13 switches the supply direction and the supply flow rate of hydraulic fluid from the motor pilot circuit 34 to the motor cylinder 12. The vehicle body controller 9 can thereby freely vary the displacement of the hydraulic motor 10.

The wheel loader 50 is provided with a forward/rearward advance maneuvering member 26. The forward/rearward advance maneuvering member 26 is maneuvered by the operator, in order to switch the vehicle into forward or rearward advance. The maneuvering position of the forward/rearward advance maneuvering member 26 is switched between a forward advance position, a rearward advance position, and a neutral position. The forward/rearward advance maneuvering member 26 sends to the vehicle body controller 9 a maneuver signal showing the position of the forward/rearward advance maneuvering member 26. By operating the forward/rearward advance maneuvering member 26, the operator can switch the wheel loader 50 between forward advance and rearward advance.

The wheel loader 50 is provided with a work implement locking maneuver section 25. The work implement locking maneuver section 25, maneuvered by the operator, is switchable between a locked position and a released position. When the work implement locking maneuver section 25 is in the locked position, the work implement 52 is locked regardless of maneuvering of the work implement maneuvering section 23. When the work implement locking maneuver section 25 is in the released position, the work implement 52 operates in response to maneuvering of the work implement maneuvering section 23. A maneuver signal showing the position of the work implement locking maneuver section 25 is sent to the vehicle body controller 9.

The wheel loader 50 is provided with an input device 24 (one example of a selector). Through the input device 24, the operator can input information relating to option selections for the wheel loader 50. Option selections include the types of link mechanisms attachable to the wheel loader 50, such as a parallel link mechanism, a Z bar link mechanism, and the like. Moreover, the input device 24 is maneuvered by the operator in order to select to enable or disable an automatic tilt function, discussed later.

The engine controller 8 is an electronic control section having an arithmetic processor device such as a CPU, various kinds of memory, and the like. The engine controller 8 controls the engine 1 in such a way as to obtain a set target rotation speed.

The vehicle body controller 9 is an electronic control section having an arithmetic processor device such as a CPU, various kinds of memory, and the like. On the basis of output signals from the detectors, the vehicle body controller 9 electronically controls the various control valves, thereby controlling the displacement of the travel hydraulic pump 5 and the displacement of the hydraulic motor 10. In specific terms, the vehicle body controller 9 outputs to the pressure control valve 29 an instruction signal based on the engine rotation speed detected by the engine rotation speed sensor 1*a*. The displacement of the travel hydraulic pump 5 is controlled thereby.

The vehicle body controller 9 processes output signals from the engine rotation speed sensor 1*a* and the drive circuit pressure detector 17, and outputs a motor displacement instruction signal to the motor displacement control section 13. The displacement of the hydraulic motor 10 is controlled thereby.

Figure 5:
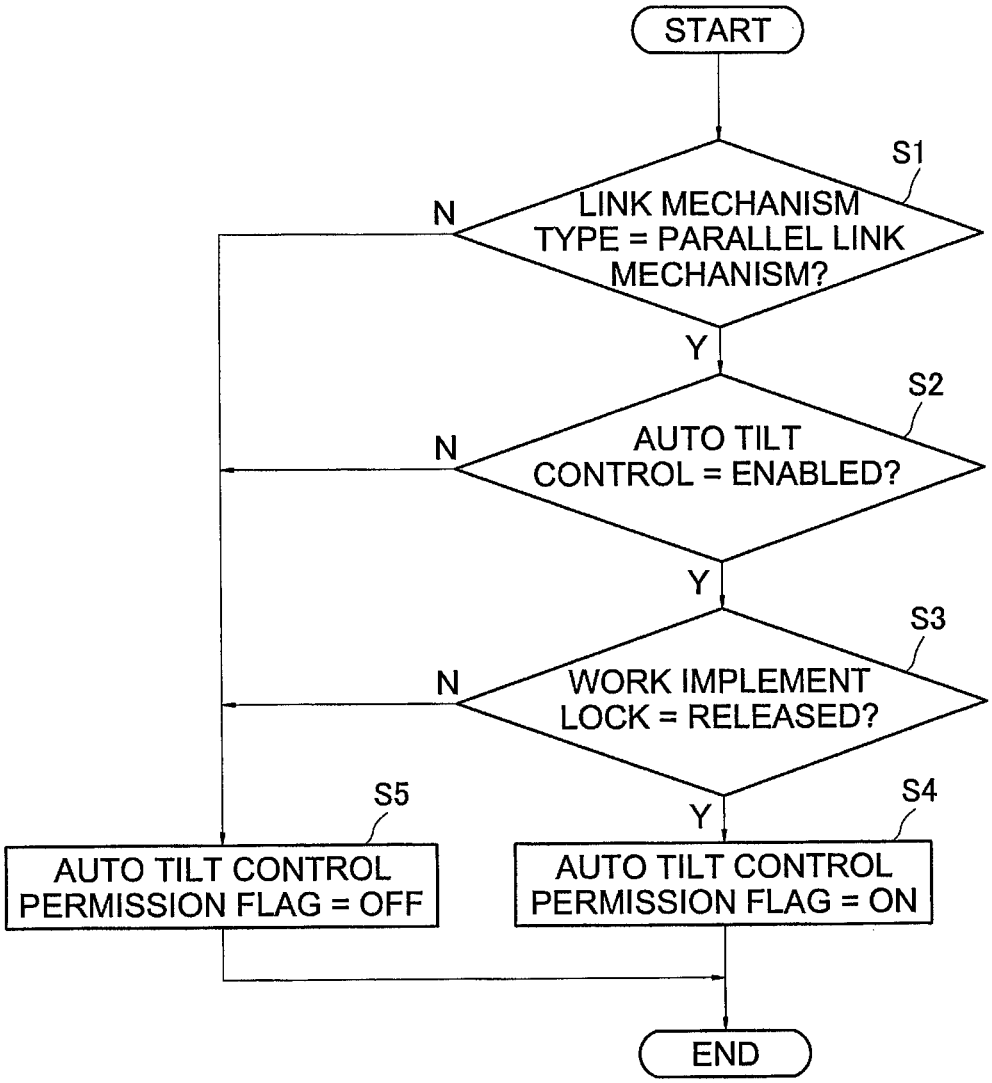
FIG. 5 is a flowchart showing a process to determine whether to execute auto tilt control.

Next, execution of auto tilt control by the vehicle body controller 9 is described. Auto tilt control is a control employed during excavation, for the purpose of automatically rotating the bucket 54 upward when the boom 53 is rotated upward within an angular range below the horizontal direction. FIG. 5 is a flowchart showing a process to decide whether to execute auto tilt control.

In Step S1, the vehicle body controller 9 determines whether the type of link mechanism has been set to "parallel link mechanism" in the option selections, by the input device 24 mentioned previously. When the type of link mechanism has been set to "parallel link mechanism," the routine advances to Step S2.

In Step S2, the vehicle body controller 9 determines whether the auto tilt control enable/disable selection has been set to "enable" in the option selections, by the input device 24 mentioned previously. When the auto tilt control enable/disable selection has been set to "enable," the routine advances to Step S3.

In Step S3, the vehicle body controller 9 determines whether locking of the work implement has been released. When the work implement locking maneuver section 25 is in the released position, the vehicle body controller 9 makes the determination that locking of the work implement has been released. When locking of the work implement has been released, the routine advances to Step S4.

In Step S4, an auto tilt control permission flag is set to ON. When the auto tilt control permission flag is ON, execution of auto tilt control is permitted. Consequently, when all of the preconditions of Step S1 to Step S3 have been met, the vehicle body controller 9 then makes a determination that auto tilt control is executable.

When at least one of the preconditions of Step S1 to Step S3 is not met, the routine advances to Step S5. In Step S5, the auto tilt control permission flag is set to OFF. When the auto tilt control permission flag is OFF, execution of auto tilt control is not permitted. Consequently, when at least one of the preconditions of Step S1 to Step S3 is not met, the vehicle body controller 9 does not execute auto tilt control.

Figure 6:
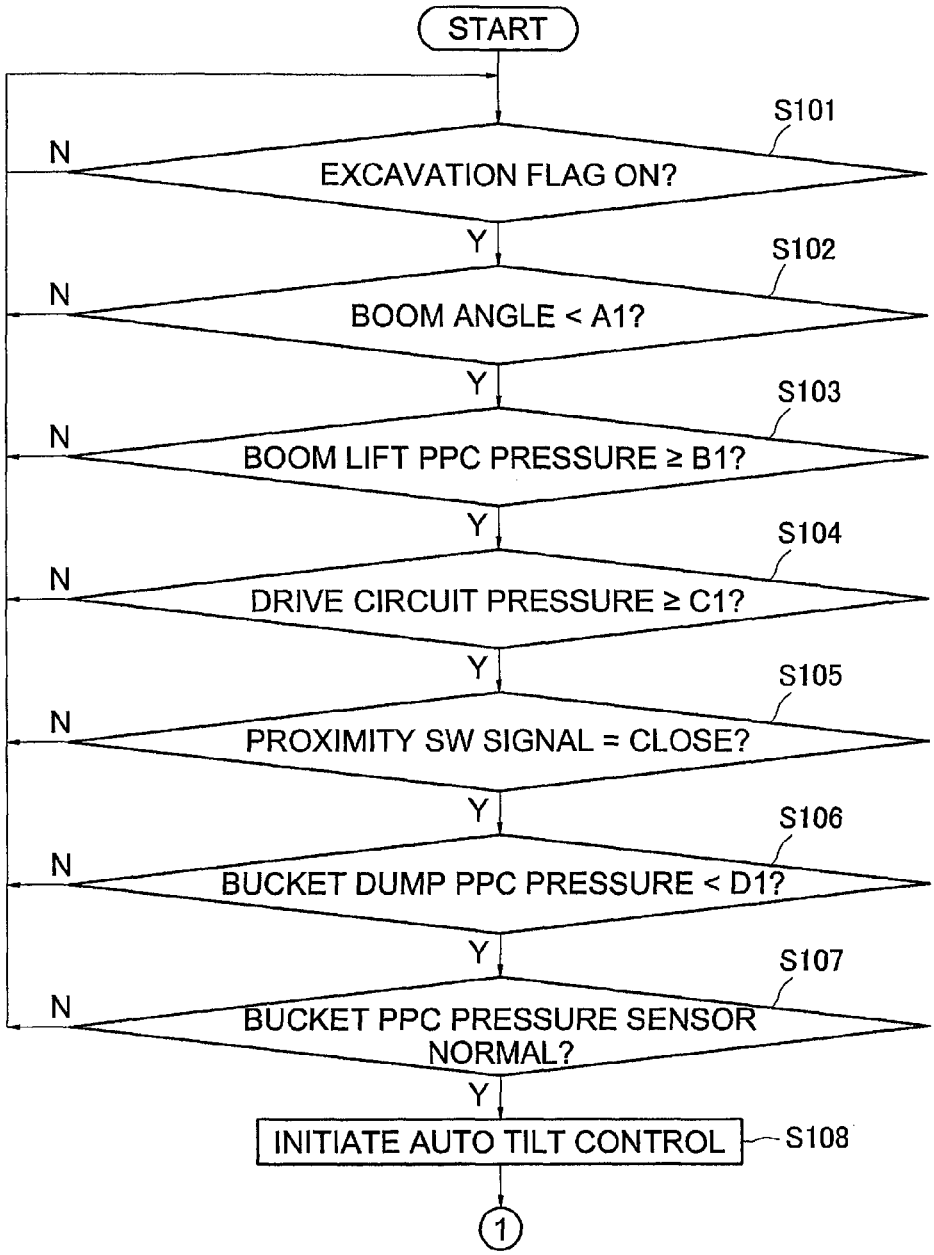
FIG. 6 is a flowchart showing a process for determining whether to initiate execution of the auto tilt control.

FIG. 6 is a flowchart showing a process for determining whether to initiate execution of auto tilt control. The vehicle body controller 9 performs the process shown in FIG. 6 when the auto tilt control permission flag is ON.

In Step S101, the vehicle body controller 9 determines whether an excavation flag is ON. The excavation flag is a flag that shows whether the wheel loader 50 is currently performing excavation. When the excavation flag is ON, the wheel loader 50 is currently performing excavation. When the excavation flag is OFF, the wheel loader 50 is not currently performing excavation.

The vehicle body controller 9 determines whether excavation is in progress, on the basis of the magnitude of the boom bottom pressure. The boom bottom pressure is the hydraulic pressure supplied to the boom cylinder 57 by rotating the boom 53 upward. For example, when predetermined preconditions, including one that the boom bottom pressure is equal to or greater than a predetermined pressure threshold value, have been met, the vehicle body controller 9 sets the excavation flag to ON. When the boom bottom pressure is equal to or greater than the predetermined pressure threshold value, this means that a load of a magnitude indicative of excavation being performed is being placed on the boom cylinder 57. When the excavation flag in ON in Step S101, the routine advances to Step S102.

In Step S102, the vehicle body controller 9 determines whether the boom angle is less than a predetermined angle threshold value A1. The angle threshold value A1 is a boom angle that is below the horizontal direction. When the boom angle is less than the predetermined angle threshold value A1, the routine advances to Step S103.

In Step S103, it is determined whether the boom lift PPC pressure is equal to or greater than a predetermined pressure threshold value B1. The boom lift PPC pressure is the boom PPC pressure for elevating the boom 53. The pressure threshold value B1 corresponds to the boom lift PPC pressure observed when the boom 53 starts to be elevated. When the boom lift PPC pressure is equal to or greater than the predetermined pressure threshold value B1, the routine advances to Step S104.

In Step S104, it is determined whether the drive circuit pressure is equal to or greater than a predetermined pressure threshold value C1. Here, the drive circuit pressure is the hydraulic pressure observed in a case in which the hydraulic motor 10 is driven in the direction of forward advance (for example, the hydraulic pressure of the first drive circuit 20*a*). Consequently, the drive circuit pressure is employed as a traction parameter showing the magnitude of traction of the wheel loader 50 towards the direction of forward advance. The pressure threshold value C1 corresponds to the traction of the wheel loader 50 observed when the bucket is in a state of being thrust into earth. When the drive circuit pressure is equal to or greater than the predetermined pressure threshold value C1, the routine advances to Step S105.

In Step S105, the vehicle body controller 9 determines whether the signal from the proximity switch 37 is CLOSE. When the signal from the proximity switch 37 is CLOSE, this means that the bucket angle θbu does not exceed a predetermined threshold value. In other words, when the signal from the proximity switch 37 is CLOSE, this means that the bucket 54 is in a position at which the reaction force to which it is subjected during excavation or the like is considerable. When the signal from the proximity switch 37 is CLOSE, the routine advances to Step S106.

In Step S106, the vehicle body controller 9 determines whether the bucket dump PPC pressure is less than a predetermined pressure threshold value D1. The bucket dump PPC pressure is the bucket PPC pressure for dumping the bucket 54. The pressure threshold value D1 corresponds to the bucket dump PPC pressure observed when no maneuvering to dump the bucket 54 is being performed. When the bucket dump PPC pressure is less than the predetermined pressure threshold value D1, the routine advances to Step S107.

In Step S107, the vehicle body controller 9 determines whether the bucket PPC pressure sensor 36 is normal. For example, when the voltage of the signal from the bucket PPC pressure sensor 36 is within the appropriate range, the vehicle body controller 9 makes a determination that the bucket PPC pressure sensor 36 is normal. When the bucket PPC pressure sensor 36 is normal, the routine advances to Step S108.

In Step S108, the vehicle body controller 9 initiates auto tilt control. In auto tilt control, the vehicle body controller 9 controls the tilt angle of the bucket 54 on the basis of automatic tilt instruction information. The tilt angle means the bucket angle observed during operation to tilt the bucket 54.

Figure 7:
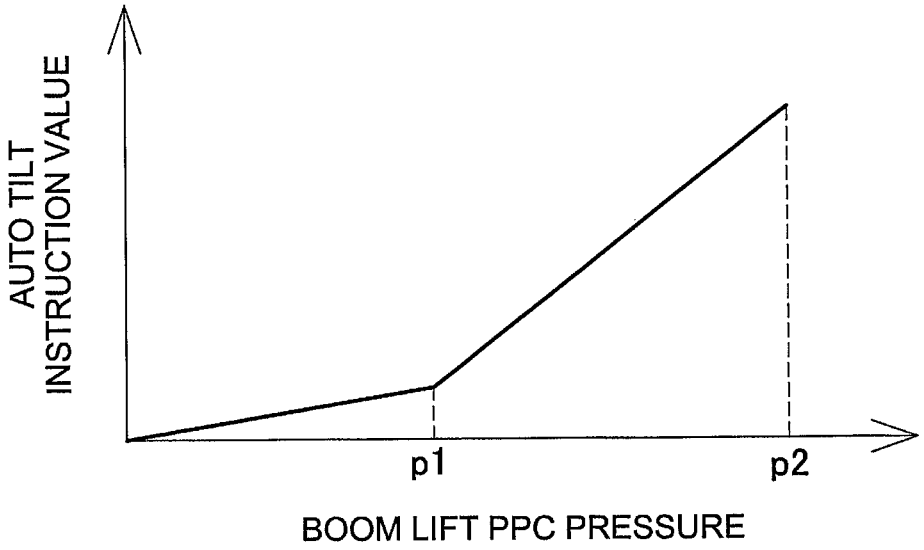
FIG. 7 is a drawing showing an example of the automatic tilt instruction value information.

FIG. 7 shows an example of automatic tilt instruction value information. The automatic tilt instruction value information defines a relationship between automatic tilt instruction values and the boom lift PPC pressure. The automatic tilt instruction values are instruction values for presentation to the bucket tilt control valve 61. Consequently, the vehicle body controller 9 controls the tilt angle of the bucket 54 in response to the boom lift PPC pressure. As shown in FIG. 7, in the automatic tilt instruction value information, the automatic tilt instruction values are greater at greater boom lift PPC pressure. At greater automatic tilt instruction values, the bucket tilt control valve 61 supplies a greater bucket PPC to the bucket control valve 35. Specifically, at greater boom lift PPC pressure, the tilt angle is greater.

To describe in greater detail, in the automatic tilt instruction value information, when the boom lift PPC pressure is in a range greater than p1 but no more than p2, the automatic tilt instruction values increase at a greater rate with respect to the boom lift PPC pressure, than in a range of boom lift PPC pressure of p1 or below. Consequently, when the boom lift PPC pressure is low, the amount of increase in the tilt angle during auto tilt control is small.

Figure 8:
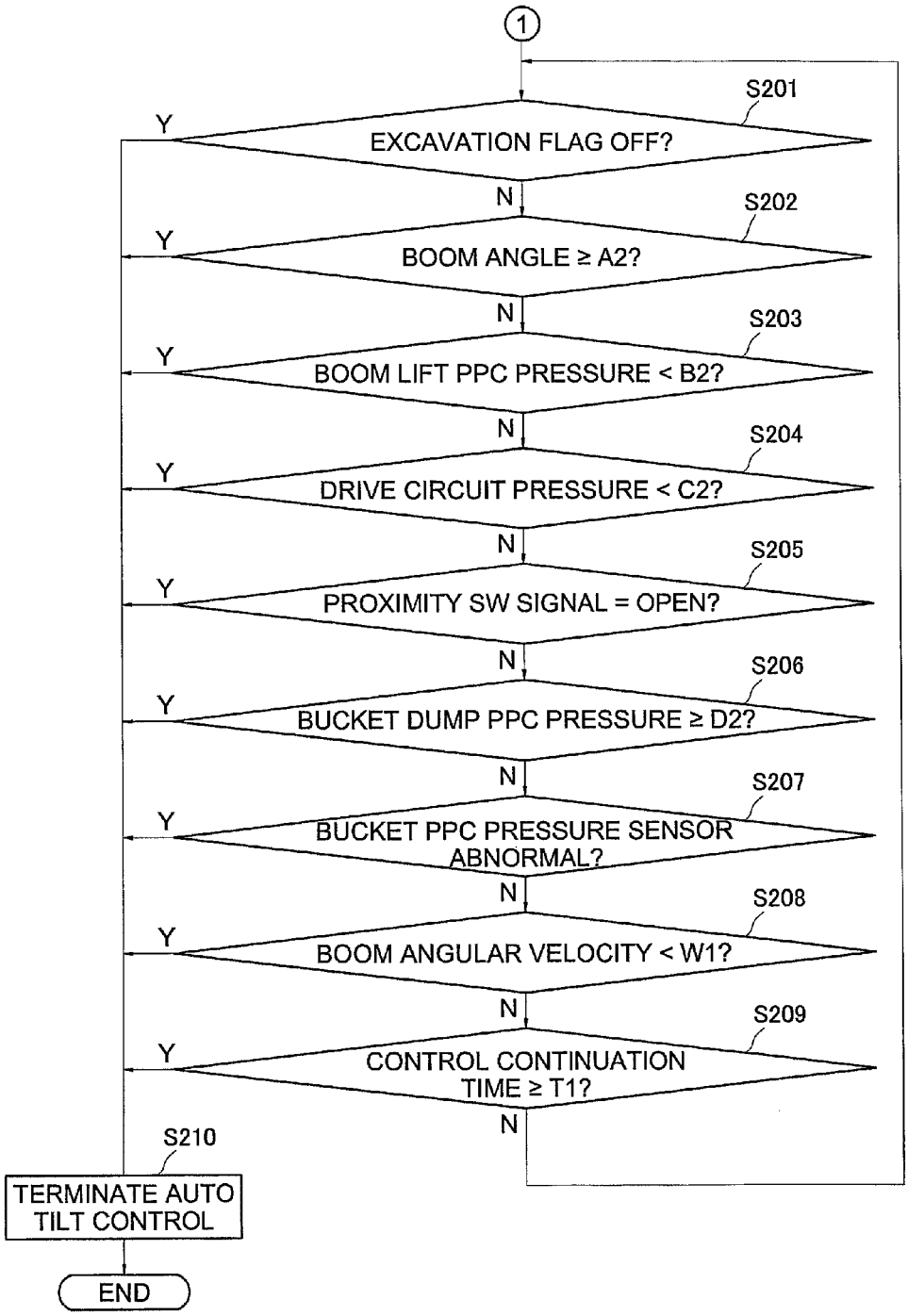
FIG. 8 is a flowchart showing a process for determining whether to terminate the auto tilt control.

FIG. 8 is a flowchart showing a process for determining whether to terminate auto tilt control. In Step S201, the vehicle body controller 9 determines whether the excavation flag is OFF. When the excavation flag is OFF, the routine advances to Step S210. In Step S210, the vehicle body controller 9 terminates auto tilt control.

In Step S202, the vehicle body controller 9 determines whether the boom angle is equal to or greater than a predetermined angle threshold value A2. The angle threshold value A2 may be a value identical to or different from the angle threshold value A1 mentioned previously. The angle threshold value A2 is an angle that is lower than the horizontal direction. When the boom angle is equal to or greater than the predetermined angle threshold value A2, in Step S210, the vehicle body controller 9 terminates auto tilt control. Consequently, when the boom angle has increased from an angle smaller than the predetermined angle A1 and reached the predetermined angle A2, the vehicle body controller 9 terminates auto tilt control.

In Step S203, it is determined whether the boom lift PPC pressure is less than a predetermined pressure threshold value B2. The pressure threshold value B2 may be a value identical to or different from the pressure threshold value B1 mentioned previously. When the boom lift PPC pressure is less than the predetermined pressure threshold value B2, the vehicle body controller 9 terminates auto tilt control in Step S210.

In Step S204, it is determined whether the drive circuit pressure is less than a predetermined pressure threshold value C2. Here, the drive circuit pressure is the hydraulic pressure observed in a case in which the hydraulic motor is driven in the direction of forward advance (for example, the hydraulic pressure of the first drive circuit 20*a*). The pressure threshold value C2 may be a value identical to or different from the pressure threshold value C1 mentioned previously. When the drive circuit pressure is less than the predetermined pressure threshold value C2, in Step S210, the vehicle body controller 9 terminates auto tilt control.

In Step S205, the vehicle body controller 9 determines whether the signal from the proximity switch 37 is OPEN. When the signal from the proximity switch 37 is OPEN, this means that the bucket angle θbu exceeds a predetermined threshold value. In other words, when the signal from the proximity switch 37 is OPEN, this means that the bucket 54 is in a position at which the reaction force to which it is subjected during excavation or the like is not excessive. When the signal from the proximity switch 37 is OPEN, in Step S210, the vehicle body controller 9 terminates auto tilt control.

In Step S206, the vehicle body controller 9 determines whether the bucket dump PPC pressure is equal to or greater than a predetermined pressure threshold value D2. The pressure threshold value D2 may be a value identical to or different from the pressure threshold value D1 mentioned previously. When the bucket dump PPC pressure is equal to or greater than the predetermined pressure threshold value D2, in Step S210, the vehicle body controller 9 terminates auto tilt control.

In Step S207, the vehicle body controller 9 determines whether the bucket PPC pressure sensor 36 is abnormal. For example, when the voltage of the signal from the bucket PPC pressure sensor 36 is not within the appropriate range, the vehicle body controller 9 makes a determination that the bucket PPC pressure sensor 36 is abnormal. When the bucket PPC pressure sensor 36 is abnormal, in Step S210, the vehicle body controller 9 terminates auto tilt control.

In Step S208, the vehicle body controller 9 determines whether the boom angular velocity is less than a predetermined angular velocity threshold value W1. The vehicle body controller 9 calculates the boom angular velocity on the basis of detection values from the boom angle sensor 38, for example. The angular velocity threshold value W1 is a small enough value that the boom 53 is not considered to be elevated. When the boom angular velocity is less than the predetermined angular velocity threshold value W1, in Step S210, the vehicle body controller 9 terminates auto tilt control.

In Step S209, the vehicle body controller 9 determines whether the auto tilt control continuation time is equal to or greater than a predetermined time threshold value T1. When the auto tilt control continuation time is equal or greater than the predetermined time threshold value T1, in Step S210, the vehicle body controller 9 terminates auto tilt control. Consequently, when the predetermined time T1 has elapsed since auto tilt control was initiated, the vehicle body controller 9 terminates auto tilt control.

In the above manner, the vehicle body controller 9 terminates auto tilt control when at least one of the preconditions of Steps S201 to S209 is met. In other words, the vehicle body controller 9 continues auto tilt control as long as all of the preconditions of Steps S1 to S9 are met.

With the wheel loader 50 according to the present embodiment, once the operator performs a boom lifting maneuver during excavation, the boom 53 rotates upward in response to the amount of maneuvering thereof. In interlocking fashion with this operation of the boom 53, the link mechanism 59 changes the bucket relative angle θbu' in response to variation of the boom angle θbo, in such a way that the bucket angle θbu stays fixed. At this time, the vehicle body controller 9 executes auto tilt control, as long as the boom 53 is within a predetermined angular range lower than the horizontal direction (an angular range of less than the angle threshold value A1). The bucket 54 is rotated upwards thereby.

Figure 9:
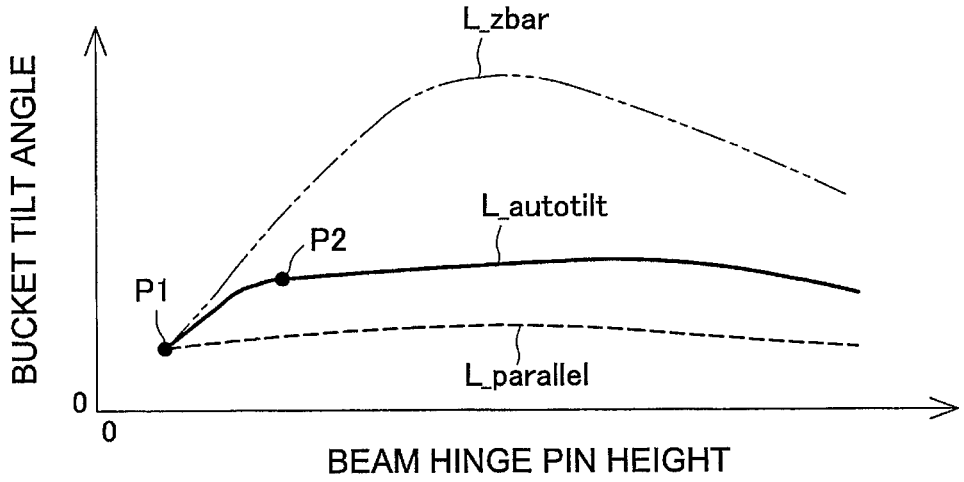
FIG. 9 is a drawing showing variation of the tilt angle of a bucket when the auto tilt control is executed in a wheel loader.

FIG. 9 shows variation of the tilt angle of the bucket, with respect to the height of the boom hinge pin, when auto tilt control is executed in the wheel loader 50 according to the present embodiment. As shown in FIG. 2, the height of the boom hinge pin corresponds to the height H of the bucket center of rotation O2. Consequently, the height of the boom hinge pin is increased by a boom lifting operation. In FIG. 9, L_autotilt shows the variation of the tilt angle when auto tilt control is executed in the wheel loader 50 according to the present embodiment. L_parallel shows the variation of the tilt angle in a conventional wheel loader provided with a parallel link mechanism, but in which auto tilt control is not executed (hereinafter termed a "conventional parallel link type wheel loader"). L_Zbar shows the variation of the tilt angle in a conventional wheel loader provided with a Z bar link mechanism (hereinafter termed a "Z bar link type wheel loader").

As shown in FIG. 9, with the wheel loader 50 according to the present embodiment, from the point in time P1 that excavation is initiated to a point in time P2 immediately after excavation is initiated, the tilt angle increases to a greater extent than it would in the conventional parallel link type wheel loader. The tilt angle thereby varies in a manner comparable to that of the Z bar link type wheel loader. This is because, by performing auto tilt control, the bucket 54 is controlled automatically in such a way as to increase the tilt angle.

From point in time P2 onwards, variation of the tilt angle is smaller. The tilt angle thereby varies in a manner comparable to the conventional parallel link type wheel loader. This is because, by terminating auto tilt control, the only variation of the tilt angle observed is variation due to the attitude-retention function of the link mechanism 59, with the exception of variation of the tilt angle due to maneuvering by the operator.

In the manner shown above, in the wheel loader 50 according to the present embodiment, the bucket 54 rotates upward automatically when excavation is first initiated. Therefore, satisfactory excavation workability can be obtained, even when the operator does not perform maneuvering of the bucket 54 simultaneously with maneuvering of the boom 53.

As shown by Step S209 in FIG. 8, the vehicle body controller 9 terminates auto tilt control when the predetermined time T1 has elapsed since auto tilt control was initiated. Consequently, automatic control of the bucket 54 is limited to the time that excavation is initiated, when the reaction force to which work implement 52 is subjected is strong. Unnecessary automatic control of the bucket 54 is thereby kept to a minimum.

As shown by Step S202 in FIG. 8, the vehicle body controller 9 terminates auto tilt control when the boom angle reaches a predetermined angle A2 below the horizontal direction. Consequently, auto tilt control is canceled when the bucket 54 is raised to a major extent. Maneuverability can thereby be improved through the attitude-retention function of the link mechanism 59, in a state in which the bucket 54 has been raised to a major extent.

The vehicle body controller 9 determines whether excavation is currently in progress, on the basis of the magnitude of the boom bottom pressure. The vehicle body controller 9 can thereby accurately determine whether excavation is currently in progress.

As shown by Step S104 in FIG. 6, the preconditions for initiating auto tilt control include one that the drive circuit pressure is equal to or greater than the predetermined threshold value C1. Consequently, auto tilt control is executed when traction in the direction of forward advance is strong. Auto tilt control can thereby be performed under circumstances in which the work implement 52 is subjected to strong reaction force.

When auto tilt control is unnecessary, the operator can disable auto tilt control through the input device 24. Control of the bucket when unnecessary to do so can be kept to a minimum thereby, improving maneuverability.

As shown by Step S3 in FIG. 5, when the work implement locking maneuver section 25 is not in the released position, specifically, when the work implement locking maneuver section 25 is in the locked position, the vehicle body controller 9 makes a determination that execution auto tilt control is disallowed. Consequently, when the work implement 52 is locked by the work implement locking maneuver section 25, auto tilt control is not executed. Unwanted execution of auto tilt control can thereby be avoided.

While the present invention has been described in terms of the presently preferred embodiment, the present invention is not limited to the aforedescribed embodiment, and various changes are possible without departing from the scope and spirit of the invention.

In the aforedescribed embodiment, an example of a wheel loader equipped with a one-motor, one-pump HST system including one hydraulic pump and one travel hydraulic motor was described. However, the present invention is not limited to this. The present invention may be applied, for example, to a wheel loader equipped with a one-pump, two-motor HST system including one hydraulic pump and two travel hydraulic motors.

In the aforedescribed embodiment, an HST system is shown as an exemplary travel mechanism; however, the travel mechanism may be a mechanism for driving a drive shaft via a torque converter and/or a transmission. In this case, for the torque parameter, traction calculated from the speed ratio of the torque converter may be used as the torque parameter.

Preconditions different from the exemplary preconditions shown in the aforedescribed embodiment may be adopted as the preconditions to decide whether to execute auto tilt control, the preconditions for initiating auto tilt control, the preconditions for terminating auto tilt control, or the preconditions for determining the excavation flag.

In the aforedescribed embodiment, a bucket is shown as an exemplary work tool, but other work tools may be employed.

In the aforedescribed embodiment, the vehicle body controller and the engine controller are disclosed as being constituted separately, but an integrated controller would be acceptable as well. Alternatively, the vehicle body controller may be constituted by a plurality of controllers.

In the aforedescribed embodiment, a bucket angle sensor may be employed in place of the proximity switch 37. The bucket angle sensor would detect the bucket angle θbu or the bucket relative angle θbu'. In this case, in Step S105 mentioned previously, the vehicle body controller 9 would determine whether the bucket angle θbu or the bucket relative angle θbu' is smaller than a predetermined angle threshold value. Moreover, in Step S205 mentioned previously, the vehicle body controller 9 would determine whether the bucket angle θbu or the bucket relative angle θbu' is smaller than a predetermined angle threshold value.

Figure 10:
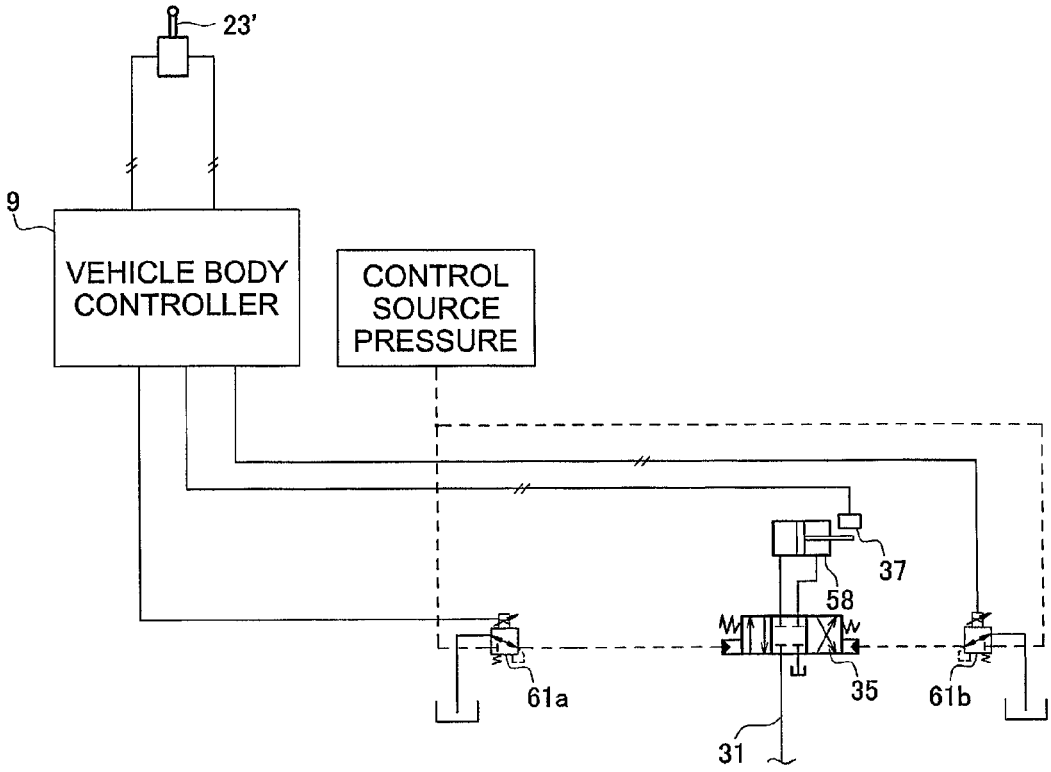
FIG. 10 is a block diagram showing the constitution of a hydraulic circuit outfitted to a wheel loader according to a modification example.

In the aforedescribed embodiment, the work implement maneuvering section 23 is a pneumatically controlled maneuvering section, but an electrically controlled maneuvering section could be employed as well. FIG. 10 is a block diagram showing the constitution of a hydraulic circuit outfitted to a wheel loader according to a modification example. In FIG. 10, constitutions like those in the embodiment discussed previously are assigned like reference numerals.

As shown in FIG. 10, the wheel loader according to the modification example is provided with a work implement maneuvering section 23'. The work implement maneuvering section 23' is an electrically controlled maneuvering section. The work implement maneuvering section 23' outputs to the vehicle body controller 9 a maneuver signal commensurate with the amount of maneuvering. For example, the work implement maneuvering section 23' outputs to the vehicle body controller 9 a maneuver signal having a voltage commensurate with the amount of maneuvering. The wheel loader according to the modification example also has a first bucket tilt control valve 61*a* and a second bucket tilt control valve 61*b*. The first bucket tilt control valve 61*a* and the second bucket tilt control valve 61*b* are electromagnetic control valves that, on the basis of a control signal from the vehicle body controller 9, control the pilot pressure applied to the bucket control valve 35.

On the basis of a maneuver signal from the work implement maneuvering section 23', the vehicle body controller 9 determines an instruction value for presentation to the first bucket tilt control valve 61*a* and the second bucket tilt control valve 61*b*. However, when execution of auto tilt control is currently in progress, the vehicle body controller 9 determines, as the instruction value for presentation to the first bucket tilt control valve 61*a*, the greater of an instruction value determined on the basis of auto tilt instruction value information, and the instruction value determined on the basis of the maneuver signal from the work implement maneuvering section 23'.

Figure 11:
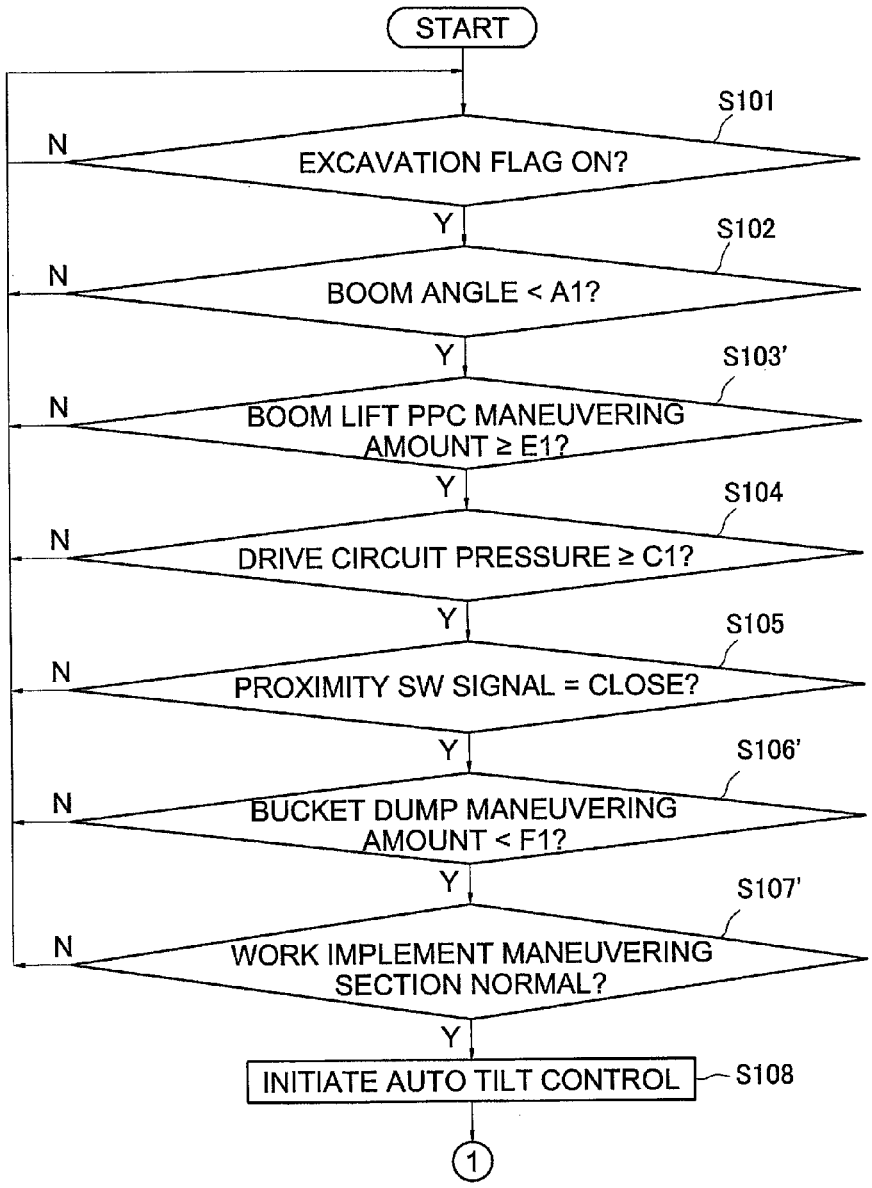
FIG. 11 is a flowchart showing a process for determining whether to initiate execution of the auto tilt control according to a modification example.

FIG. 11 is a flowchart showing a process for determining whether to initiate execution of auto tilt control according to a modification example. As shown in FIG. 11, in Step S103', the vehicle body controller 9 determines whether the amount of boom lift maneuvering is equal to or greater than an amount of maneuvering threshold value E1. The amount of boom lift maneuvering is the amount of maneuvering of the work implement maneuvering section 23' in order to elevate the boom 53.

In Step S106', the vehicle body controller 9 determines whether the amount of bucket dump maneuvering is less than an amount of maneuvering threshold value F1. The amount of bucket dump maneuvering is the amount of maneuvering of the work implement maneuvering section 23' in order to dump the bucket 54. The vehicle body controller 9 acquires the amount of boom lift maneuvering and the amount of bucket dump maneuvering, on the basis of a maneuver signal from the work implement maneuvering section 23'.

In Step S107', the vehicle body controller 9 determines whether the work implement maneuvering section 23' is normal. For example, on the basis of whether the voltage range of the signal from the work implement maneuvering section 23' is within the appropriate range, the vehicle body controller 9 determines whether the work implement maneuvering section 23' is normal. The other processes shown in FIG. 11 are analogous to the processes shown in FIG. 6.

Figure 12:
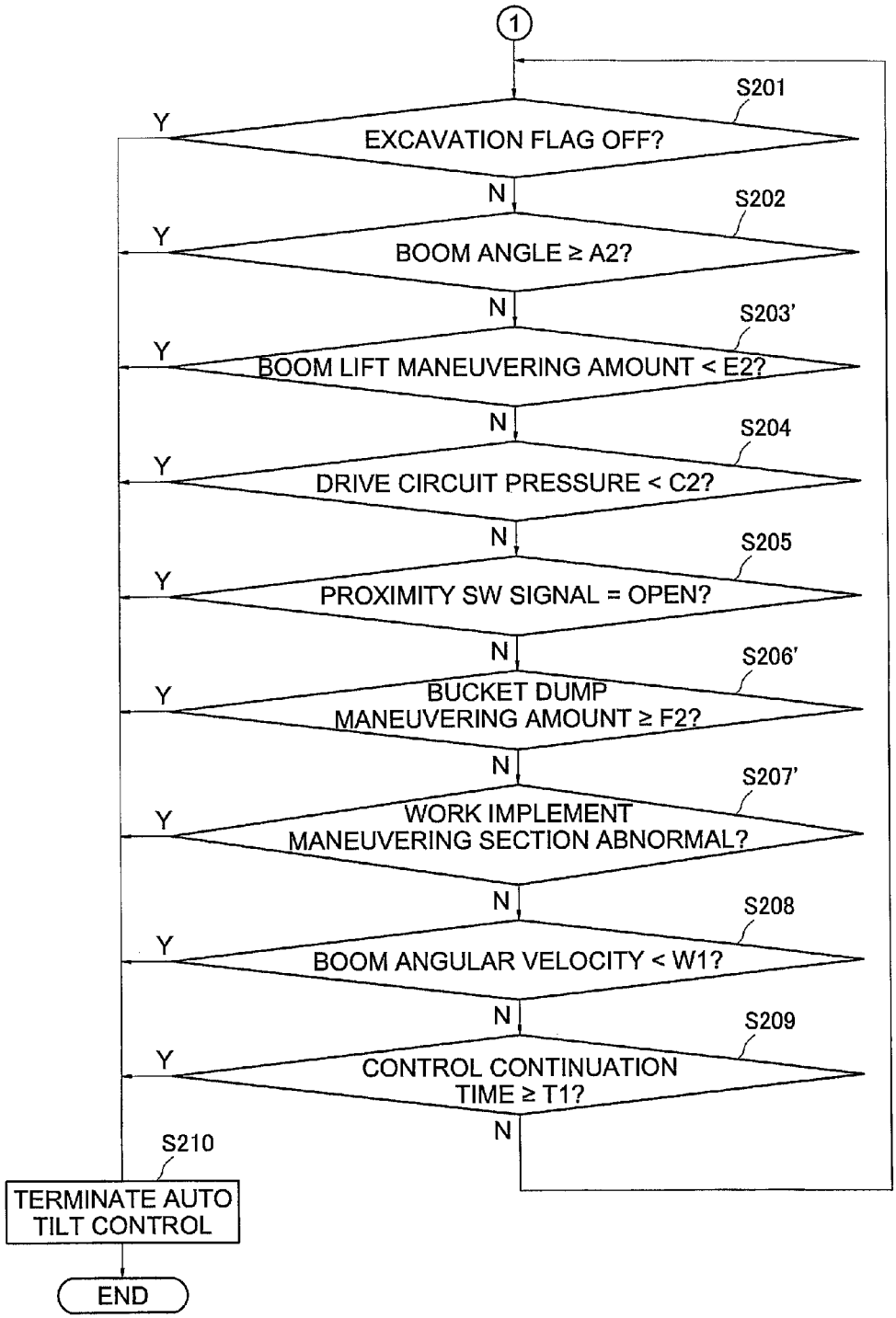
FIG. 12 is a flowchart showing a process for determining whether to terminate the auto tilt control according to a modification example.

FIG. 12 is a flowchart showing a process for determining whether to terminate auto tilt control according to the modification example. As shown in FIG. 12, in Step S203', the vehicle body controller 9 determines whether the amount of boom lift maneuvering is less than a predetermined amount of maneuvering threshold value E2. In Step S206', the vehicle body controller 9 determines whether the amount of bucket dump maneuvering is equal to or greater than a predetermined amount of maneuvering threshold value F2. In Step S207', the vehicle body controller 9 determines whether the work implement maneuvering section 23' is normal. The other processes shown in FIG. 12 are analogous to the processes shown in FIG. 8.

According to the illustrated embodiment, there is offered a wheel loader whereby satisfactory excavation workability can be obtained, though simple maneuvering.

The invention claimed is:

1. A wheel loader comprising:

a vehicle body;

a work implement having a boom attached rotatably in an up and down direction to the vehicle body, and a work tool attached rotatably in the up and down direction to a distal end of the boom;

a link mechanism configured and arranged to change a relative angle of the work tool with respect to the boom when the boom is rotated upward, such that an amount of variation of an angle of the work tool with respect to a horizontal direction is less than an amount of variation of an angle of the work tool with respect to the horizontal direction when the boom is rotated upward while the work tool is at a fixed relative angle with respect to the boom;

a control section configured to execute an auto tilt control that causes the work tool to rotate upward when the boom is rotated upward within an angular range below the horizontal direction during excavation; and a traction parameter detector configured and arranged to detect a value of a traction parameter indicative of a magnitude of traction of the wheel loader towards a direction of forward advance, wherein the control section is configured to determine whether to execute the auto tilt control based on whether the traction parameter is equal to or greater than a predetermined value.

2. The wheel loader according to claim 1, wherein the control section is configured to terminate the auto tilt control when a predetermined time interval has elapsed from a start time of the auto tilt control.

3. The wheel loader according to claim 1, wherein the control section is configured to terminate the auto tilt control when an angle of the boom with respect to the horizontal direction has reached a predetermined angle below the horizontal direction.

4. The wheel loader according to claim 1, further comprising a work implement hydraulic pump configured and arranged to discharge hydraulic fluid, wherein the work implement further has a boom cylinder configured and arranged to drive the boom, and the control section is configured to determine whether excavation is currently taking place based on a magnitude of a hydraulic pressure supplied to the boom cylinder to rotate the boom upward.

5. The wheel loader according to claim 1, further comprising a selector configured and arranged to select whether to enable or disable the auto tilt control.

6. The wheel loader according to claim 1, further comprising:

a work implement maneuvering section configured and arranged to maneuver the work implement; and a work implement locking maneuver section configured and arranged to lock the work implement regardless of maneuvering by the work implement maneuvering section, wherein when the work implement is locked by the work implement locking maneuver section, the control section is configured not to execute the auto tilt control.

7. A wheel loader control method, provided with comprising:

rotating a boom upwards;

changing a relative angle of a work tool with respect to the boom by a link mechanism when the boom is rotated upward, such that an amount of variation of an angle of the work tool mounted to a distal end of the boom, with respect to a horizontal direction, is less than an amount of variation of the angle of the work tool with respect to the horizontal direction when the boom is rotated upward while the work tool is at a fixed relative angle with respect to the boom;

executing an auto tilt control for causing the work tool to rotate upward when the boom is rotated upward within an angular range below the horizontal direction during excavation; and detecting a value of a traction parameter indicative of a magnitude of traction of the wheel loader towards a direction of forward advance, the executing of the auto tile control including determining whether to execute the auto tilt control based on whether the traction parameter is equal to or greater than a predetermined value.

* * * * *